US007987918B2

(12) United States Patent
Fehrle et al.

(10) Patent No.: US 7,987,918 B2
(45) Date of Patent: Aug. 2, 2011

(54) ELECTRIC HAND-HELD POWER TOOL

(75) Inventors: Siegfried Fehrle, Leinfelden-Echterdingen (DE); Thomas Bernhardt, Aichtal-Groetzingen (DE); Michael Weiss, Stuttgart (DE); Andreas Schlegel, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 1113 days.

(21) Appl. No.: 11/351,087

(22) Filed: Feb. 9, 2006

(65) Prior Publication Data

US 2006/0201690 A1 Sep. 14, 2006

(30) Foreign Application Priority Data

Mar. 9, 2005 (DE) ..... 10 2005 010 793

(51) Int. Cl.
*B25F 5/02* (2006.01)

(52) U.S. Cl. ..... 173/1; 173/217; 173/171

(58) Field of Classification Search ..... 173/170, 173/171, 162.1, 162.2, 216, 217, 48; 310/50, 310/89, 239, 241
See application file for complete search history.

(56) References Cited

U.S. PATENT DOCUMENTS

| | | | | |
|---|---|---|---|---|
| 1,702,742 | A * | 2/1929 | Moretti | 173/217 |
| 2,752,514 | A * | 6/1956 | Schwenden | 310/50 |
| 2,965,774 | A * | 12/1960 | Rangus | 310/50 |
| 3,908,139 | A * | 9/1975 | Duncan, Jr. | 310/50 |
| 4,081,704 | A * | 3/1978 | Vassos et al. | 310/50 |
| 4,342,931 | A * | 8/1982 | Grossmann et al. | 310/50 |
| 4,389,779 | A * | 6/1983 | Overbury et al. | 30/382 |
| 4,522,270 | A * | 6/1985 | Kishi | 173/217 |
| 4,730,134 | A * | 3/1988 | Sistare | 310/50 |
| 5,036,926 | A * | 8/1991 | Cavedo | 173/104 |
| 5,394,039 | A * | 2/1995 | Suchdev et al. | 310/51 |
| 5,407,381 | A * | 4/1995 | Schaefer et al. | 451/358 |
| 5,531,538 | A * | 7/1996 | Stolzer | 403/374.4 |
| 5,642,008 | A * | 6/1997 | McCracken | 310/50 |
| 6,206,107 | B1 * | 3/2001 | Wadge | 173/217 |
| 6,405,807 | B1 * | 6/2002 | Pan | 173/217 |
| 6,602,122 | B1 * | 8/2003 | Rudolf et al. | 451/344 |
| 6,634,439 | B2 * | 10/2003 | Driessen | 173/217 |
| 6,672,402 | B2 * | 1/2004 | Ortt et al. | 173/1 |
| 6,860,342 | B1 * | 3/2005 | Wu et al. | 173/217 |
| 6,886,614 | B2 * | 5/2005 | Ricono et al. | 144/28.11 |
| 6,886,643 | B2 * | 5/2005 | Riley et al. | 173/29 |
| 7,055,622 | B2 * | 6/2006 | Bone | 173/217 |
| 7,090,032 | B2 * | 8/2006 | Wada et al. | 173/217 |
| 2003/0066667 | A1 * | 4/2003 | Zhang | 173/217 |

FOREIGN PATENT DOCUMENTS

| | | |
|---|---|---|
| DE | 101 53 574 A1 | 8/2003 |
| DE | 102 27 782 | 1/2004 |
| GB | 2 384 918 | 8/2003 |

* cited by examiner

*Primary Examiner* — Lindsay Low
(74) *Attorney, Agent, or Firm* — Michael J. Striker

(57) ABSTRACT

An electric hand-held power tool has a housing, a double-shelled handle attached axially to the housing, a selector ring pivotably located in the housing, and an actuating element supported by the selector ring and swivelable manually. The housing and the handle have a line connecting domes oriented parallel to an axis of the housing and located in a parting plane region between the housing and the handle for receiving connecting units. The connecting domes include centering elements for guiding and exactly positioning the handle shells when the handle shells are attached individually to the housing.

12 Claims, 4 Drawing Sheets

ELECTRIC HAND-HELD POWER TOOL

CROSS-REFERENCE

The invention described and claimed hereinbelow is also described in DE 10 2005 019 793, filed Mar. 9, 2005. This German Patent Application, whose subject matter is incorporated here be reference, provides the basis for a claim of priority of invention under 35 U.S.C. 119(a)-(d).

BACKGROUND OF THE INVENTION

The present invention is directed to an electric hand-held power tool.

With electric hand-held power tools, the selector ring that can be pivoted using the actuating element capable of being gripped externally on the housing serves to change the direction of rotation of a reversible electric motor that drives the tool, the electric motor being designed as a commutator motor. The brush holder of the motor is typically coupled with the selector ring so that, when the selector ring is pivoted to change the direction of rotation, the brush holder is also pivoted, so that the displacement of the commutator brushes—which are displaced out of the neutral position by an angle of rotation to improve commutation—is adapted to the changing direction of rotation of the rotor.

Known electric hand-held power tools (DE 101 53 574 A1, DE 102 27 782 A1) include a pot-shaped housing with an integrally-molded pistol grip. The pistol grip is covered from behind with a handle cover. The commutator motor—the direction of rotation of which can be changed—installed in the housing extends with its rotor through the pot base, and a brush holder enclosing the commutator in an annular manner with diametrically opposed commutator brushes is retained on the exterior of the pot base such that it can pivot around the commutator axis. Contacts and conductor tracks for switching the stator winding of the commutator motor when the brush holder is pivoted are located on the brush holder and the pot base. A switching lever is used to pivot the brush holder. The switching lever can be gripped on the underside of the housing and encloses a segment formed on the brush holder with a shift fork.

With electric hand-held power tools, a "combination pot/shell design" is known, in the case of which a handle composed of two connected handle shells is screwed to the pot-shaped machine housing. The handle is pre-installed by inserting one handle shell in an assembly mold shaped for the handle shell and equipping and connecting it with the on/off switch, power connection cord, grommet, strain relief and the required connecting lines, including the lines toward the machine housing. Subsequently, the second handle shell is placed on the first handle shell and the handle shells are screwed together using aligned connecting domes formed in both handle shells. The handle pre-installed in this manner is inserted axially on the housing and screwed to the housing via axially oriented connecting domes formed in the housing. The selector ring with actuating element and the brush holder connected therewith are installed in the housing, and the actuating element is guided out of the machine interior in the parting plane between the housing and the handle.

SUMMARY OF THE INVENTION

Accordingly, it is an object of the present invention to provide an electric hand-held power tool which is a further improvement of the existing power tools of this type.

In keeping with these objects and with others which will become apparent hereinafter, one feature of the present invention resides, briefly stated, in an electric hand-held power tool, comprising a housing; a double-shelled handle attached axially to said housing; a selector ring pivotally located in said housing; an actuating element supported by said selector ring and which can be swiveled manually, said housing and said handle including a line connecting domes oriented parallel to an axis of said housing and located in a parting plane region between said housing and said handle for receiving connecting means, said connecting domes including centering means for guiding and exactly positioning handle shells when said handle shells are attached individually to said housing.

The electric hand-held power tool according to the present invention has the advantage that a simple and economical assembly of the machine is attained via the design of connecting domes and centering means.

The handle shells can be inserted, individually and with an exact fit, on the housing. The housing shell that is inserted first can have been installed previously and requires no further correction after the second housing shell is installed. As a result, the housing shell installed first can be outfitted with the handle components, such as an on/off switch, power connection cord, grommet, strain relief and the required connecting lines to the machine housing, and these components can be electrically interconnected. When the components are installed in this manner, the housing shell no longer needs to be inserted in an installation shell for fixation, since it is already attached to the housing. An installation shell that is otherwise required is therefore eliminated.

The second housing shell, which can be attached with an exact fit, subsequently forms the closed handle in combination with the first housing shell. In addition, the ease with which the machine can be serviced is improved considerably, since, e.g., when the commutator brushes are replaced, only the handle shell that was installed last need be removed. The connecting domes and centering means can be easily formed during injection-molding of the housing shell, so that only a minimum amount of additional effort is required for the injection-molding.

According to a preferred embodiment of the present invention, the centering means of a first handle shell and the housing include associated axial centering means designed to guide and position the first handle shell when it is attached axially to the housing, and the other, second handle shell and housing include associated radial centering means designed to guide and position the second handle shell when it is attached to the first handle shell in a manner that is transverse to the housing axis. This different configuration of the centering means further simplifies the assembly of the electric hand-held power tool.

According to an advantageous embodiment of the present invention, the actuating element, at the least, and preferably the actuating element with selector ring, is positioned in the handle such that it is offset toward the rear relative to the parting plane between the handle and the housing. The advantage of this is that guiding the actuating element out of the machine interior is made easier in terms of production engineering, since it is easier to create the wall opening required therefor in the housing shells than in the pot-shaped housing that accommodates the motor and transmission.

The actuating element can be located independently of the placement of the selector ring and brush holder in the housing in any position that is ergonomically advantageous to the user, which improves the handling of the machine. Installation of the brush holder, selector ring and actuating element is also simplified, since the installation site for these components on the pot base is freely accessible from any side. When the handle is attached to the housing, the brush holder, selector ring and actuating element are covered by the handle.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
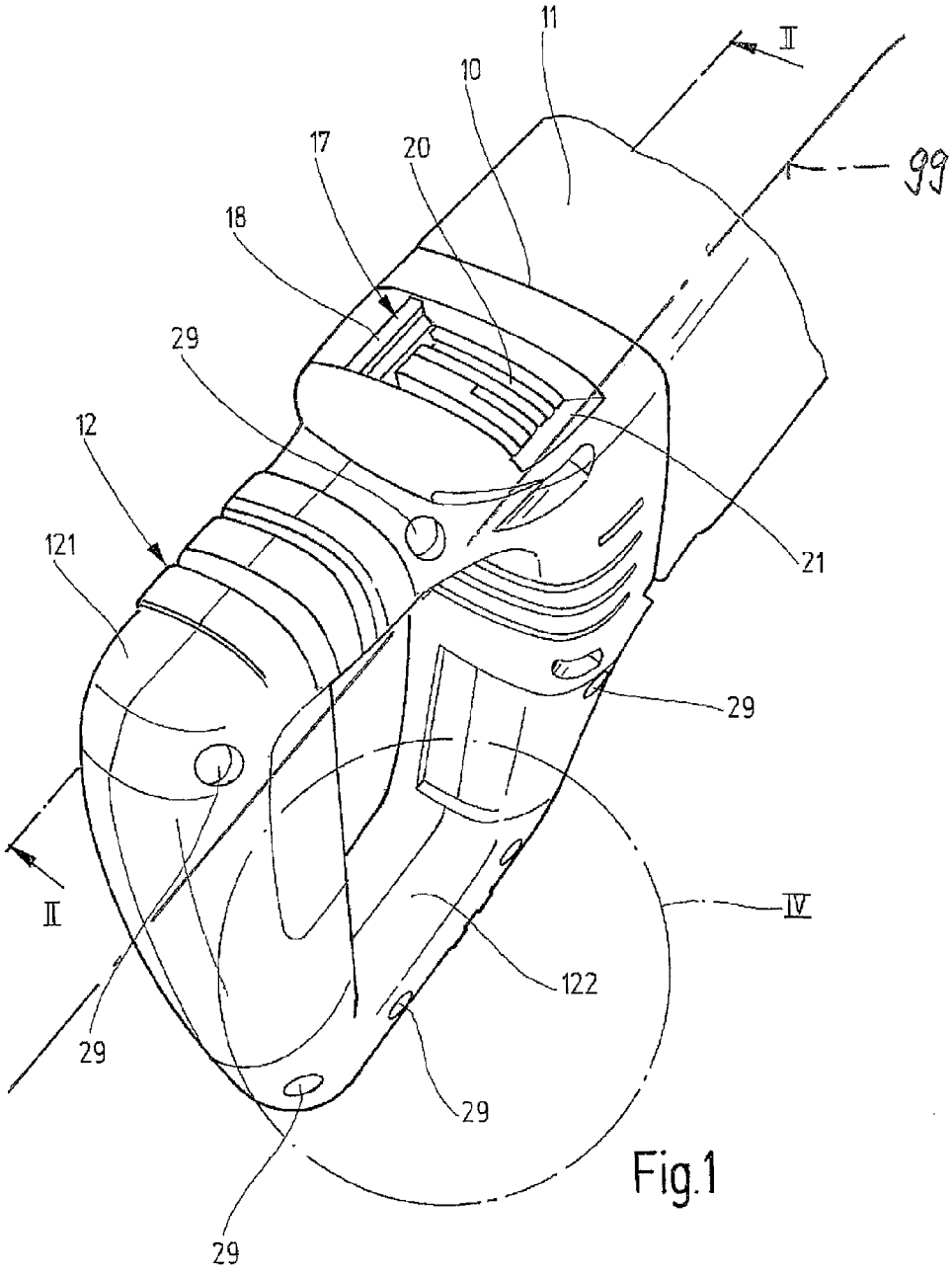
FIG. 1 Shows a section of a perspective drawing of an electric hand-held power tool with a pot-shaped housing (a section of which is shown) and a double-shelled handle, FIG. 2 Shows a section of a longitudinal sectional view along the line II-II in FIG. 1, FIG. 3 Shows a top view of the end face of the housing facing the handle, FIG. 4 Shows a perspective depiction of one handle shell of the handle in section IV in FIG. 1, FIG. 5 Shows a perspective view of the end face of the housing—a section of which is shown—facing the handle, FIG. 6 Shows a perspective view of the end face of a (sun-side) handle shell of the handle facing the housing, FIG. 7 Shows a perspective view of the end face of the other (shadow side) handle shell of the handle facing the housing.
Figure 2:
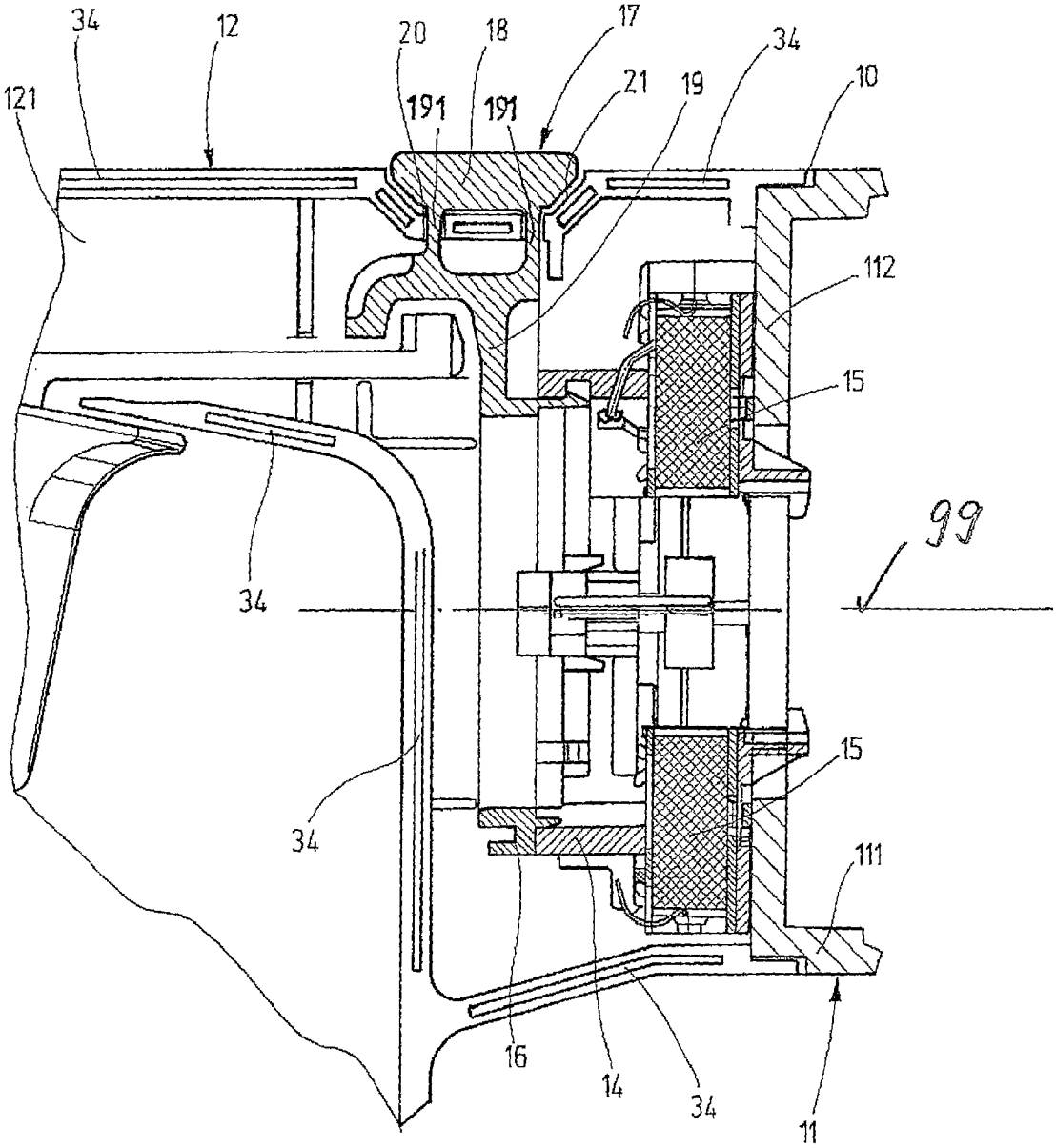
Figure 3:
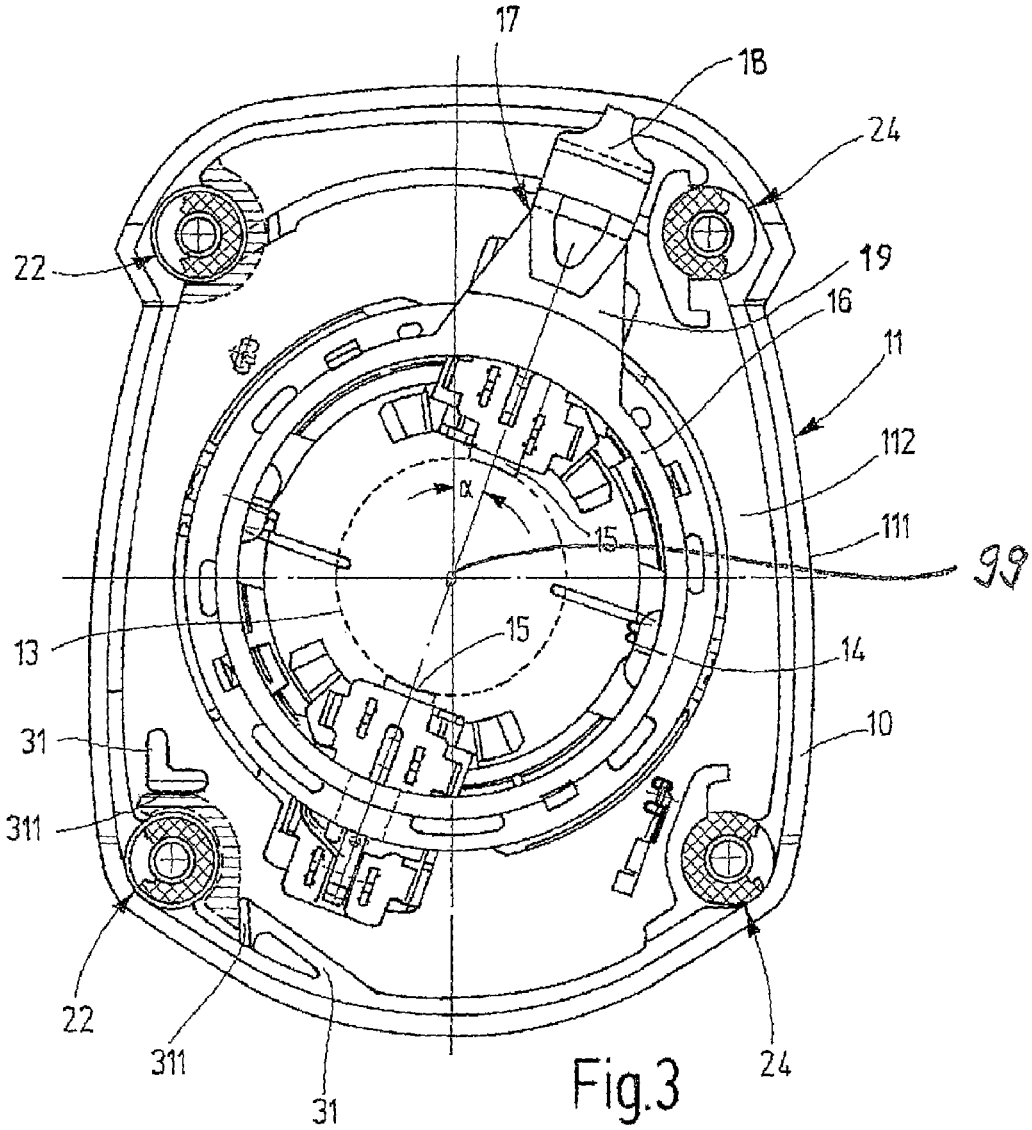

The electric hand-held power tool shown—in sections—in a perspective view in FIG. 1 and in a longitudinal sectional view in FIG. 2 has a pot-shaped housing 11 with a pot jacket 111 and a pot base 112, and a double-shelled handle 12 attached axially to housing 11 and fastened to housing 11, the two mirror-image handle shells 121, 122 being joined in a plane lying in the housing axis. A commutator motor—the direction of rotation of which is changeable—is accommodated in housing 11. FIG. 3 shows a top view of pot base 112 of housing 11, with commutator 13 represented by a dashed line and being non-rotatably mounted on an armature or rotor of the commutator motor extending through pot base 112.

A brush holder 14 concentrically enclosing commutator 13 is located on the exterior of pot base 112, brush holder 14 having two diametrically positioned commutator brushes 15, the brushes being displaced out of the neutral position by an angle of rotation □ (FIG. 3) to improve commutation. Brush holder 14 is pivotably retained on pot base 112 and can be rotated out of the position shown in FIG. 3 around angle 2□ in the counterclockwise direction. A selector ring 16 is rigidly coupled with brush holder 14. It is possible to pivot selector ring 16 manually using an actuating element 17. Actuating element 17 includes a fork-type arm 19 integrally molded on selector ring 16 and extending radially, and two integrally-molded, separate, parallel segments 191 and a handle element 18 that can be gripped on the exterior of housing 11.

The handle element 18 is integrally joined with segments 191. Selector ring 16 is used to change the direction of rotation of the commutator motor. For this purpose, contact elements (not shown) are located on selector ring 16 and/or brush holder 14 non-rotatably connected with selector ring 16. When selector ring 16 and brush holder 14 are pivoted out of an end position shown in FIG. 3, for example, and into another end position, the polarity of the armature winding of the commutator motor is changed.

The rotation of brush holder 14 taking place as a result ensures that sufficient commutation is also ensured in the new direction of rotation of the commutator motor. Selector ring 16 and actuating element 17 are designed such that they are axially offset in handle 12 toward the rear relative to parting plane 10 between housing 11 and handle 12. Segments 191 of actuating element 17 extend through a window 20 in handle 12 extending transversely to the housing axis, and handle element 18 is located outside on handle 12 in a recess 21 formed in handle 12. Half of window 20 and half of recess 21 are formed in each of the two handle shells 121, 122.

Figure 5:
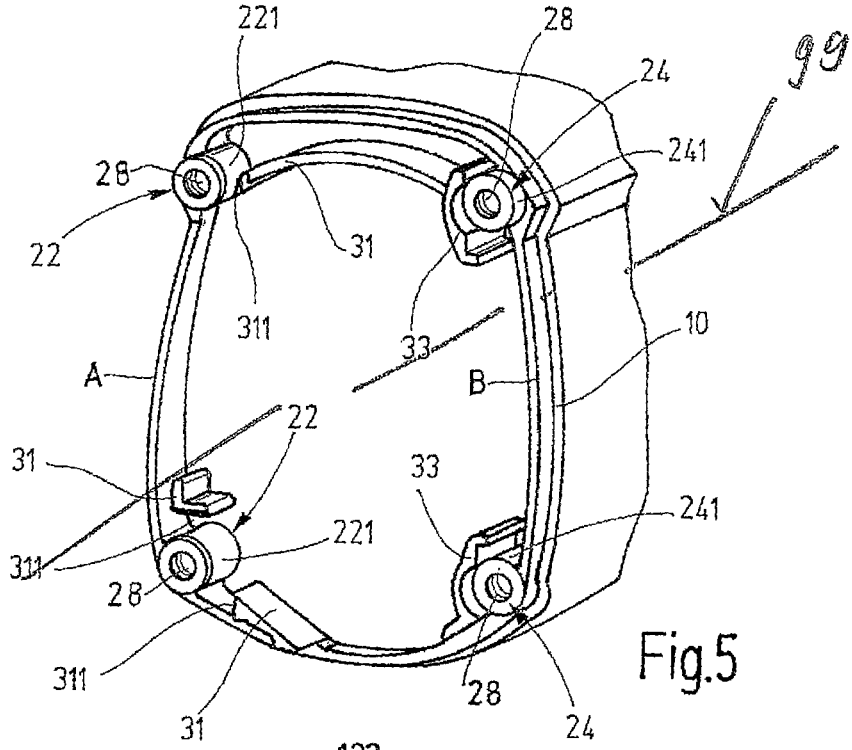
Figure 6:
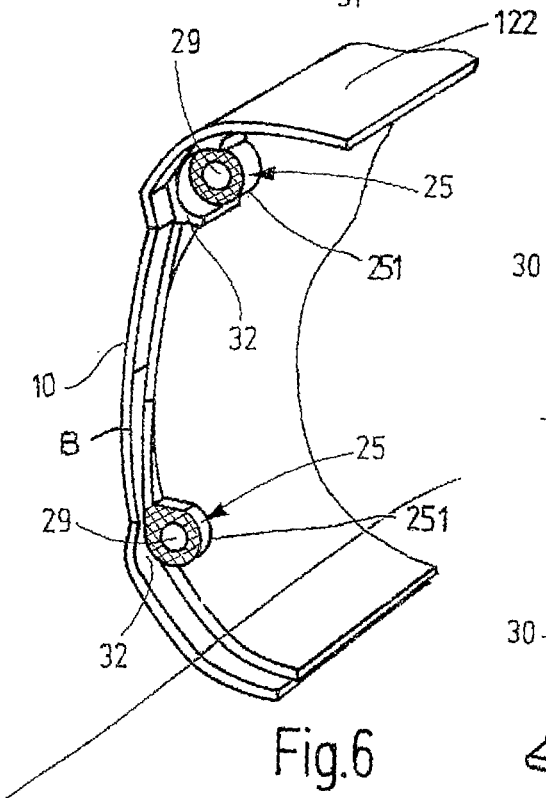
Figure 7:
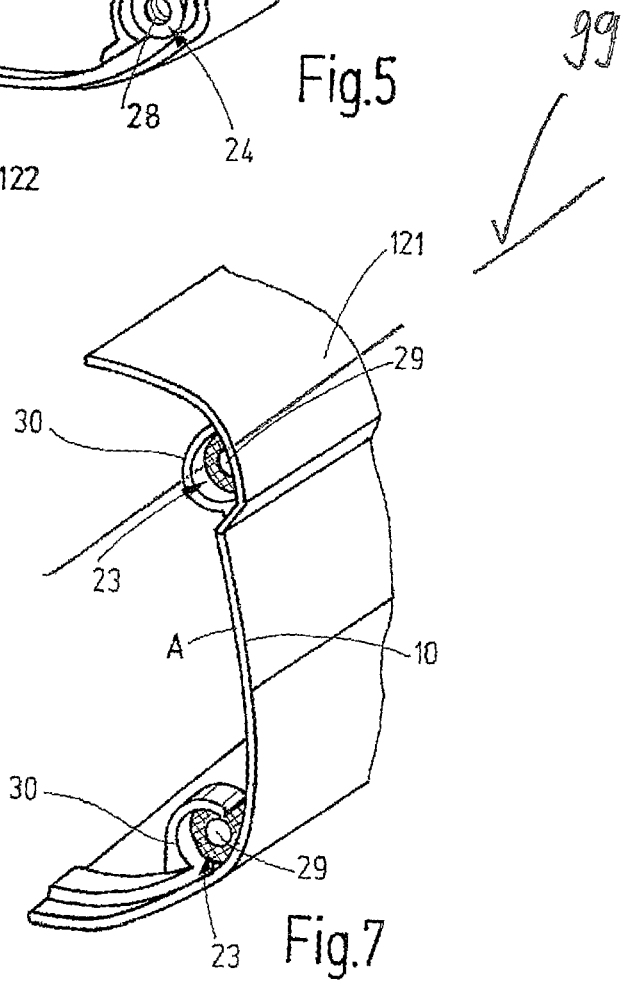

To connect handle 12 and housing 11, connecting domes are provided in the parting plane region of housing 11 and handle 12 to receive connecting means, and centering means associated with the connecting domes are provided to ensure that handle 12 is attached to housing 11 in the correct position. Housing-side connecting domes 22, 24 are shown in FIGS. 3 and 5, and handle-side connecting domes 23, 25 are shown in FIGS. 6 and 7. Housing-side connecting domes 22, 24 are each provided with a central blind hole 28, while handle-side connecting domes 23, 25 include pass-through channels 29 for inserting fastening screws into blind holes 28.

Corresponding axial centering means are formed on connecting domes 23 of a first handle shell 121 (FIG. 7)—referred to below as sun-side handle shell 121 to ensure easy distinction—and on connecting domes 22 associated with connecting domes 23 in housing 11 (FIGS. 3 and 5), the axial centering means serving to guide and position sun-side handle shell 121 during axial attachment to housing 11. Corresponding radial centering means are formed on connecting domes 25 of the other, second handle shell 122 (FIG. 6)—referred to below as shadow-side handle shell 122 to ensure easy distinction—and on connecting domes 24 associated with connecting domes 25 in housing 11 (FIGS. 3 and 5) for guiding and positioning shadow-side handle shell 122 during attachment of handle shell 122 to housing 11 and sun-side handle shell 121 in a manner that is transverse to the housing axis.

As shown in FIGS. 3 and 5 and in FIG. 7, each of which shows a view of housing 11 and sun-side handle shell 121 in a view of the separating-plane side, the axial centering means include shell segments 30 associated with handle-side connecting domes 23. Each shell segment 30 extends axially past the end face of connecting dome 23 and, when sun-side handle shell 121 is attached axially to housing 11, slides onto jacket surface 221 of associated connecting dome 22 on housing 11 in a form-fit manner.

Fixing elements 31 with axially-extending support shoulders 311 are associated with the two housing-side connecting domes 22, support shoulders 311 being located at a distance from the particular connecting dome 22 on housing 11 such that shell segments 30, which slide onto jacket surfaces 221 of connecting dome 22, rest with their outer surfaces on support shoulders 311. Two fixing elements 31 of this type are associated with connecting dome 22 shown at the bottom of FIG. 5, fixing elements 31 being located such that support shoulders 31 1 extend toward each other at nearly right angles, i.e., one extends vertically and the other horizontally in the drawing in FIG. 5. Only one fixing element 31 with a nearly vertically-extending support shoulder 311 is associated with upper connecting dome 22.

As shown in FIGS. 3 and 5 and in FIG. 6, each of which shows a view of housing 11 and shadow-side handle shell 122 in a view of the parting-plane side, the radial centering means include shell segments 32 associated with the two handle-side connecting domes 25, both shell segments 32 extending axially past the end faces of connecting domes 25. Shell segments 32 correspond with jacket surfaces 241 of the two associated, housing-side connecting domes 24 and rest against jacket surfaces 241 when shadow-side handle shell 122 is inserted transversely to the housing axis. Support elements 33 are configured on both housing-side connecting domes 24, extending past their end faces, and against which jacket surfaces 251 of handle-side connecting domes 25 of shadow-side handle shell 122 rest transversely to the housing axis.

Connecting domes oriented transversely to the housing axis are provided to connect the two housing shells 121, 122 with each other, the connecting domes resting against each other with their end faces when handle shells 121, 122 are joined to form handle 12. Connecting domes 26 located in sun-side handle shell 121 are the only connecting domes shown in FIG. 4. Blind holes 28 are formed in connecting domes 26, while the connecting domes in shadow-side handle shell 122 are provided with pass-through channels 29 as shown in FIG. 1, into which the fastening screws are inserted and screwed into blind holes 28 of connecting domes 26. In addition, spring-groove systems are configured on the abutting shell edges of the two handle shells 121, 122, the spring-groove systems also serving as radial centering means and which center the two handle shells 121, 122 relative to each other. Springs 34 of spring-groove combinations configured on sun-side handle shell 121 are shown in FIG. 2. Housing 11 and handle 12 are assembled as follows:

After commutator motor, brush holder 14 and selector ring 16 with actuating element 17 are preinstalled on housing 11, acutating element 17 is pivoted into the position shown in FIG. 3, in which actuating element 17 is located at a maximum distance from the. housing-side, axial centering means and is pivoted completely out of the region in which sun-side handle shell 121 is attached to housing 11. With actuating element 17 in this position, sun-side handle shell 121 is attached axially to housing 11 such that the end faces of housing 11 labelled "A" in FIGS. 5 and 7 and sun-side handle shell 121 face each other.

When attached axially, shell segments 30 located on handle-side connecting domes 23 slide onto jacket surface 221 of the two housing-side connecting domes 22. When slid further in the axial direction, shell segments 30 come to rest with their outer surfaces on the support shoulders 311 of fixing elements 31. Handle-side connecting domes 23 therefore rest, with an exact fit, on housing-side connecting domes 22. Fastening screws are inserted into pass-through channels 29 of handle-side connecting domes 23 and are screwed into blind holes 28 of housing-side connecting domes 22.

With sun-side handle shell 121 in the horizontal position, the intended components are installed, e.g., an on/off switch, power connection cord with grommet, strain relief and the required connecting lines, and these components are electrically connected with the housing-side components. Actuating element 17 is subsequently pivoted into its other end position, which causes segments 191 of actuating element 17 to be pivoted into the half of window 20 formed in sun-side handle shell 121 (FIG. 2). Actuating element 17 is therefore pivoted out of the region in which shadow-side handle shell 122 is attached to housing 11.

As shown in FIG. 3, the pivot angle of actuating element 17 up to this second end position is $2\alpha$. With actuating element 17 in this new pivot position, shadow-side handle shell 122 is attached to housing 11 such that the end faces of housing 44 and shadow-side handle shell 122 labeled "B" in FIGS. 5 and 6 now face each other and are inserted on the previously-installed, sun-side handle shell 121 transversely to the housing axis, shell segments 32 configured on handle-side connecting domes 25 of handle shell 122 becoming centered on cylindrical jacket surfaces 241 of associated housing-side connecting domes 25 in a form-fit manner. In addition, handle shell 122 becomes centered with its grooves on springs 34 of sun-side handle shell 121.

Figure 4:
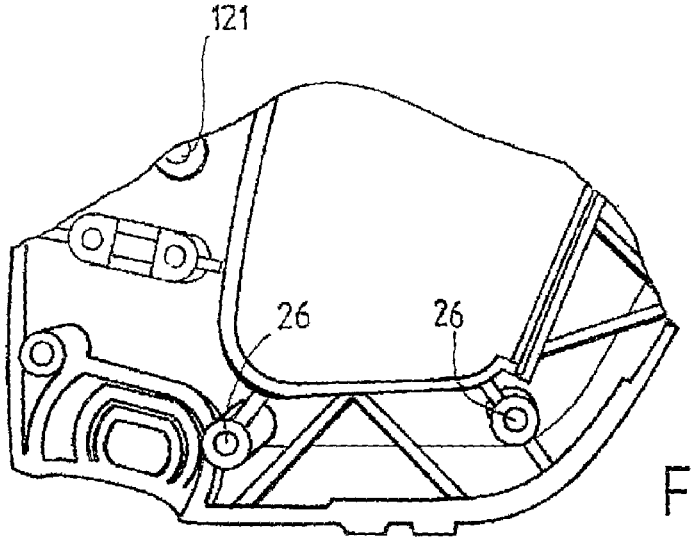

The two handle shells 121, 122 are connected using fastening screws guided through pass-through channels 29 into the connecting domes—which are oriented transversely to the housing axis (FIG. 1)—of shadow-side handle shell 122, and are screwed into blind holes 28 of connecting domes 26 in sun-side handle shell 121 (FIG. 4). In the screwed-in position, jacket surfaces 251 of connecting domes 25 in shadow-side handle shell 122 rest on support elements 33 in housing 11 transversely to the housing axis, so that shadow-side handle shell 122 is also fixed radially against the action of force. Finally, fastening screws are inserted in pass-through channels 29 of handle-side, axially oriented connecting domes 26 in shadow-side handle shell 122 and screwed into blind holes 28 of associated, housing-side connecting domes 24, so that shadow-side handle shell 122 is also clamped axially on housing 11.

During assembly, it is possible, of course, to change the order of the last two steps, so that shadow-side handle shell 122 is first clamped axially on housing 11, with the two handle shells 121, 122 being subsequently screwed together.

It will be understood that each of the elements described above, or two or more together, may also find a useful application in other types of constructions differing from the types described above.

While the invention has been illustrated and described as embodied in an electric hand-held power tool, it is not intended to be limited to the details shown, since various modifications and structural changes may be made without departing in any way from the spirit of the present invention.

Without further analysis, the foregoing will reveal fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. An electric hand-held power tool, comprising a pot-shaped housing formed as one, integral piece; a double-shelled handle having a first handle shell and a second handle shell attached individually and axially to said housing in a parting plane, wherein the parting plane is oriented transverse to a housing axis configured as a central longitudinal axis of the housing; a selector ring pivotally located in said housing; an actuating element supported by said selector ring, wherein said actuating element is adapted to be swiveled manually, said housing and said first handle shell and said second handle shell including connecting domes oriented parallel to the housing axis and located in a parting plane region between said housing and said handle, said connecting domes including centering means for guiding and exactly positioning the first handle shell and the second handle shell when said first and second handle shells are attached individually to said housing, wherein said centering means include axial centering means and radial centering means, said first handle shell and said housing including said axial centering means configured to guide and position said first handle shell when it is attached axially to said housing, while said second handle shell and said housing including said radial centering means configured to guide and position said second handle shell when it is attached to said first handle shell in a manner that is transverse to said axis of said housing, and wherein said handle shells further include connecting domes oriented transversely to said axis of said housing for receiving connecting means, said connecting domes oriented transversely to said axis of said housing resting against each other via their end faces when said handle shells are joined to form said handle.

2. An electric hand-held power tool as defined in claim 1, wherein said axial centering means include shell segments that are assigned to said connecting domes on a handle side and each located on a respective one of said connecting domes on the handle side such that each shell segment extends axially past an end face of said connecting dome and rests on an outer jacket surface of an associated one of said connecting dome on a housing side in a form-fit manner, and also include fixing elements associated with said connecting domes on said housing side with axially-extending support shoulders located on said housing at a distance from a particular one of said connecting domes on said housing side such that said shell segments that slide onto a corresponding one of said connecting domes on said housing side rest with their outer surfaces on the support shoulders.

3. An electric hand-held power tool as defined in claim 2, wherein two of said fixing elements are associated with at least one of said connecting domes on said housing side, said fixing elements being located on said housing such that said support shoulders of said fixing elements are oriented at substantially right angles to each other.

4. An electric hand-held power tool as defined in claim 1, wherein radial centering means include shell segments assigned to said connecting domes on a handle side and each located on a respective one of said connecting domes on said handle side so as to extend axially past an end face of said connecting dome on said handle side and rests on an outer jacket surface of an associated one of said connecting domes on a housing side in a form-fit manner.

5. An electric hand-held power tool as defined in claim 4, and further comprising support elements that extend past end faces of said connecting domes on said housing side and configured on said connecting domes on said housing side so as to correspond with said connecting domes on said handle side in said second handle shell, on which jacket surfaces of said connecting domes on said handle side rest in said second handle shell transverse to said axis of said housing.

6. An electric hand-held power tool as defined in claim 1, wherein said actuating element positioned in said handle such that said actuating element is offset toward a rear relative to said parting plane between said handle and said housing.

7. An electric hand-held power tool as defined in claim 1, wherein said actuating element with said selector ring is positioned in said handle such that said actuating element is offset toward a rear relative to said parting plane between said handle and said housing.

8. An electric hand-held power tool as defined in claim 1, wherein said actuating element includes a grip element grippable externally on said handle, said grip element being rigidly connected with said selector ring.

9. An electric hand-held power tool as defined in claim 8, wherein said grip element is rigidly connected with said selector ring via two segments extending through a window in said handle that extends transversely toward said axis of said housing.

10. An electric hand-held power tool as defined in claim 9, wherein said window is formed by a half-opening formed in each of said handle shells.

11. A method of assembling an electric hand-held power tool, comprising the steps of providing a housing; attaching a double-shelled handle to said housing; locating a selector ring pivotally in said housing, supporting by said selector ring an actuating element to swivel said actuating element manually; providing the housing and the handle with aligned connecting domes; orienting the connecting domes of the housing and the handle parallel to an axis of the housing and in a parting plane region between the housing and the handle for receiving connecting means; attaching handle shells individually to the housing; and providing the connecting domes with corresponding centering means for guiding an exactly positioning the handle shells when they are attached individually to the housing.

12. A method as defined in claim 11; and further comprising pivoting the actuating element installed in the housing with the selector ring out of a region for attachment of a first one of said handle shells to the housing; attaching said first handle shell axially to the housing and inserting the connecting means in the aligned connecting domes on the first handle shell and on the housing and fixing thereto; pivoting the actuating element out of an attachment area for a second one of said handle shells on the housing and into the first handle shell; inserting the second handle shell in the previously-installed first handle shell transversely to the axis of the housing; and inserting the connecting means in the connecting domes in their aligned condition and fixing the connecting means in the aligned connecting domes.

* * * * *